United States Patent [19]

Nilsen

[11] Patent Number: 4,869,345

[45] Date of Patent: Sep. 26, 1989

[54] RADOME LADDER

[76] Inventor: Arild Nilsen, Geithusveien, 3370 Vikersund, Norway

[21] Appl. No.: 216,494

[22] Filed: Jul. 8, 1988

[30] Foreign Application Priority Data

Jul. 8, 1987 [NO] Norway ..... 872838

[51] Int. Cl.[4] ..... E06C 1/36; E06C 1/383; E06C 1/397

[52] U.S. Cl. ..... 182/163; 182/197; 182/93

[58] Field of Search ..... 182/12, 13, 14, 36, 182/38, 93, 95, 163, 45, 197

[56] References Cited

U.S. PATENT DOCUMENTS

| | | | |
|---|---|---|---|
| 1,160,721 | 11/1915 | Kessler | 182/38 |
| 3,042,143 | 7/1962 | Silen | 182/163 |
| 3,070,188 | 12/1962 | Scruby | 182/163 |
| 3,095,060 | 6/1963 | Reinhardt | 182/12 |
| 3,139,949 | 7/1964 | Graves | 182/95 |
| 3,286,789 | 11/1966 | Planchon | 182/163 |
| 3,340,960 | 9/1967 | Wilson | 182/39 |
| 3,633,708 | 1/1972 | Heilskov | 182/150 |
| 3,837,429 | 9/1974 | Harris | 182/37 |
| 4,646,877 | 3/1987 | Whan | 182/45 |

FOREIGN PATENT DOCUMENTS

| | | | |
|---|---|---|---|
| 3719403 | 12/1987 | Fed. Rep. of Germany | 182/45 |

*Primary Examiner*—Reinaldo P. Machado
*Attorney, Agent, or Firm*—Wenderoth, Lind & Ponack

[57] ABSTRACT

This invention relates to a collapsible ladder for carrying out work on the surface of convex buildings as radomes and other domes. The ladder—the radome ladder—consists of a number of straight sections which are hinged together by means of brackets which are articulated externally to a section end piece at the end of each ladder section. These end pieces can be changed to suit the diameter of the dome, and the length of each ladder section, in such a way that the ladder, when unfolded, forms, in essence, an arch parallel with the surface of the dome. In each section end piece there is a castor which rolls along the dome, permitting the radome ladder to be moved sideways with ease.

3 Claims, 7 Drawing Sheets

RADOME LADDER

BACKGROUND OF THE INVENTION

1. Field of the Invention

The invention relates to a collapsible, sectioned, articulated ladder with supporting wheels; a radome ladder for external work on convex buildings, such as radomes and other domes.

2. Description of the Prior Art

A number of ladder designs are described in the literature.

U.S. Pat. No. 1,160,721 describes a ladder for use on a flat roof, with particular reference to agricultural outhouses. This ladder can be moved sideways, and is articulated to enable it to be guided past ventilator shafts and the like, but it is only suitable for flat roofs.

U.S. Pat. No. 3,042,143 discloses a portable, articulated collapsible fire-escape ladder. This ladder is so designed that it can be carried to a window or other opening in the wall of a building to furnish an escape route. This ladder is not suitable for being moved sideways by a person on the ladder, nor for use on a convex surface.

U.S. Pat. No. 3,286,789 refers to a collapsible, articulated ladder, the main purpose of this being that the ladder can be folded together for storage in a cupboard or in the boot of an ordinary private car, and be rapidly folded out to its working position. This ladder can only be used as a conventional straight ladder.

U.S. Pat. No. 3,340,960 describes a portable ladder which can be put together from a number of elements, and it is fitted with wheels which roll on tracks parallel to the wall and along the roof or sidewall of a building. This ladder can be moved by motor power along the track, controlled by an operator working on the ladder. This ladder is placed against the wall in an inclined position, and is, in addition fitted with a straight ladder which has wheels at its upper end, which lie on the roof and can thus roll sideways over the roof when the inclined ladder is moved. The inclined ladder is fitted on a motor-driven wheel unit, a "truck," which runs on the tracks along the building. Several ladders can be fitted and connected together along a wall. As illustrated by FIG. 7 of that patent, the weight of the ladder on the roof will be carried by a wheel and also the inclined ladder. This arrangement does not seem very suitable for a spherical roof. This ladder is asserted to be portable, but in its entirety it must comprise a large and complex system, which cannot be used in the same way as the present invention.

U.S. Pat. No. 3,633,708 describes a rope ladder for use when painting the outside of a spherical structure. This ladder is made of two wire ropes which carry the rungs. Spaced along the ropes there are fitted shafts for a wheel to enable the ladder to be moved sideways. The ladder's two wire ropes are joined together at the top to form a point of fixture. This fixture lies in the top point of the dome. A pre-condition for using this ladder is that it can be laid out from the top of the dome, to which there must be access through the dome, which, according to that patent, is a normal feature of water towers. That patent cannot be used to provide the facilities offered by the present invention.

U.S. Pat. No. 3,837,429 describes motor-driven scaffolding for use around buildings with rounded roofs, for example oil tanks. This scaffolding is held in position by wire ropes around air vents in the middle of the top of the tank. On the section between the roof and wall of the tank there is disposed a tubular element with built-in motor. THe wire rope to the tank's central vent is fixed to the one end of this element, while from the other end, which lies outside the tank, is suspended the scaffolding which is to be used, for example, for painting the tank. That patent differs on several counts from the present invention which will now be described.

SUMMARY

The present invention relates to a sectioned, articulated ladder—a radome ladder—for external work on spherical bodies, such as radomes and other domes, or the like, which ladder is collapsible for transportation, and when folded out in its working position, forms a rigid structure which, by means of castors at the ends of the sections, distributes the load from the weight of the ladder and the operator over the surface of the spherical body.

A second feature of this invention is that each ladder section is hinged to an adjoining ladder section by means of outward-facing brackets which are hinged to the section end pieces of adjoining ladder rails, and which carry a castor.

A further important point is that each ladder rail, at each end, is reinforced by means of a section end piece with arrests the folding out of the ladder sections at a limiting angle, alpha, which is adapted to the length of the ladder sections and the diameter of the spherical body, with the result that the unfolded ladder forms, in essence, an arch parallel with the surface of the spherical body, whereby the castors roll along this surface. The section end pieces can be welded onto the side rails, but in a preferred embodiment, the section end pieces can be changed so as to be suitable for spherical bodies of different diameters.

The invention will now be described in more detail with reference to the attached drawings.

DESCRIPTION OF THE PREFERRED EMBODIMENTS

Figure 1:
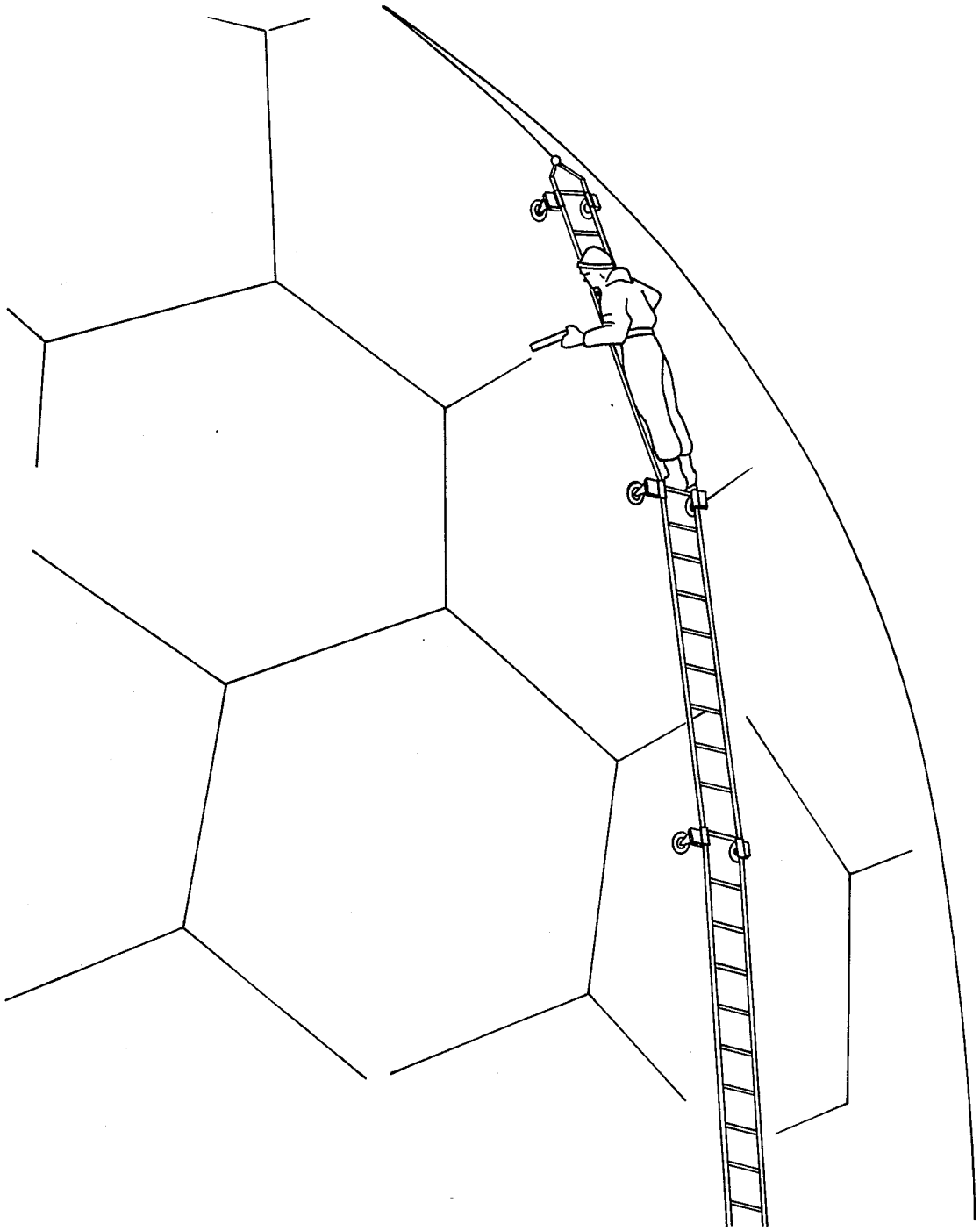
FIG. 1 illustrates the ladder in use on a radome.

In the following, the drawings are described in more detail:

FIG. 1 depicts a ladder consisting of three sections, in use on a radome.

Figure 2:
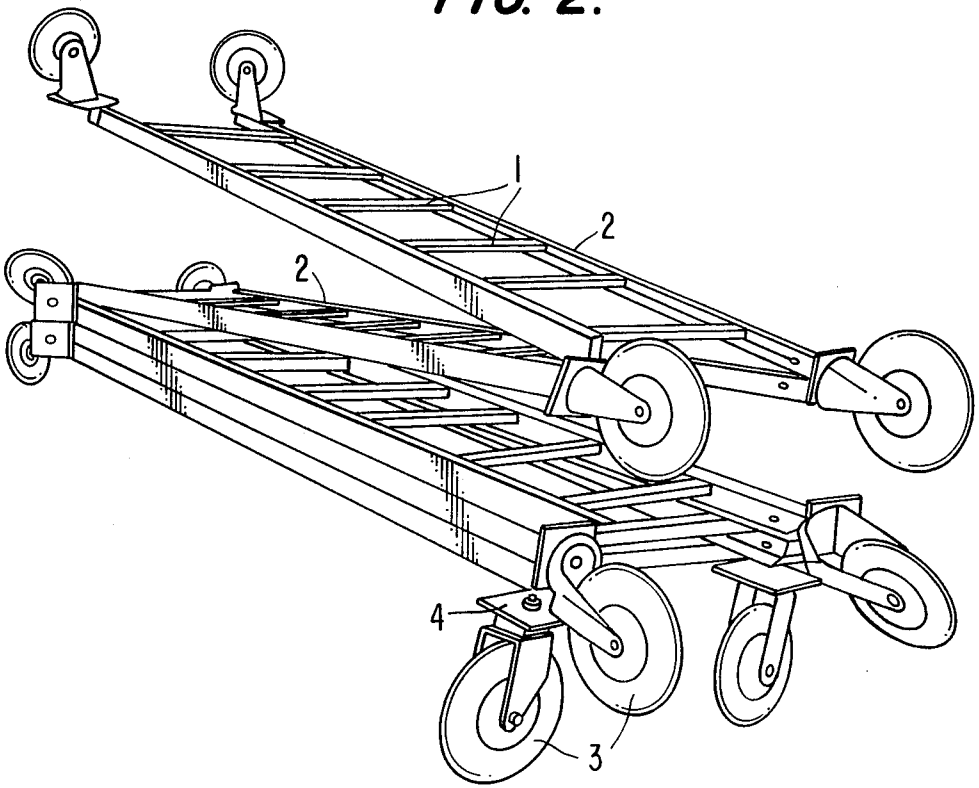
FIG. 2 shows the ladder folded, with two ladder sections raised.

FIG. 2 shows the five section ladder with rungs 1, side rails 2, and castors 3, fixed to bracket 4.

Figure 3B:
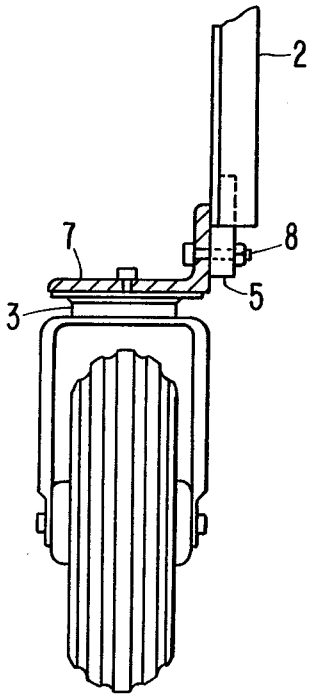
FIG. 3B is a section of a castor.
Figure 3A:
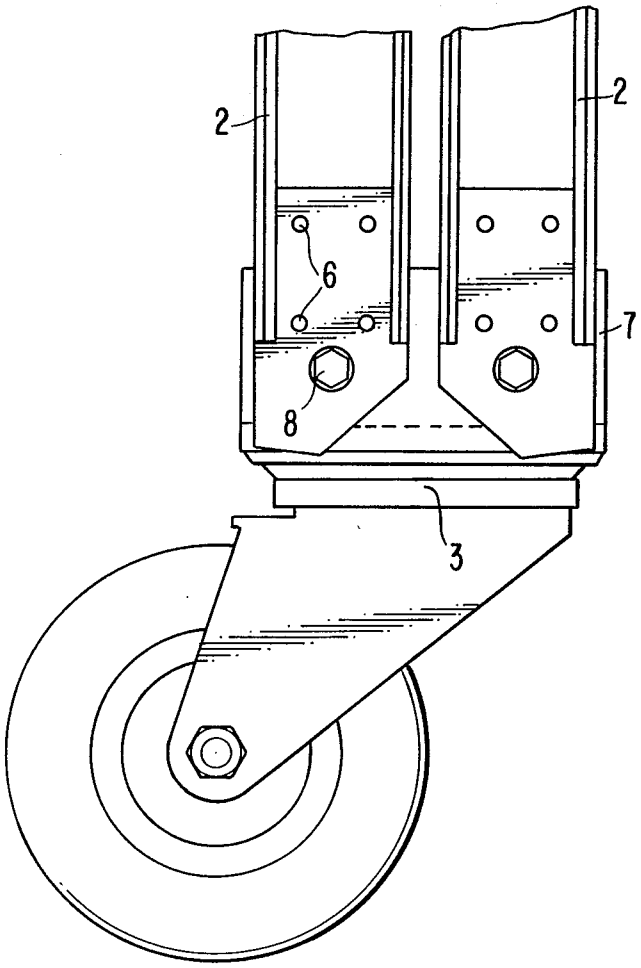
FIG. 3A illustrates: two adjoining section ends with castors, with the ladder completely folded together.

FIG. 3 shows in more detail how the section end piece 5 is fixed to the side rail 2 with screws 6, whilst bracket 7 is partly hidden by side rails 2. 8 indicates that screws (bolts) which provide the swivelling fixture for the bracket to the section end piece 5.

Figure 4:
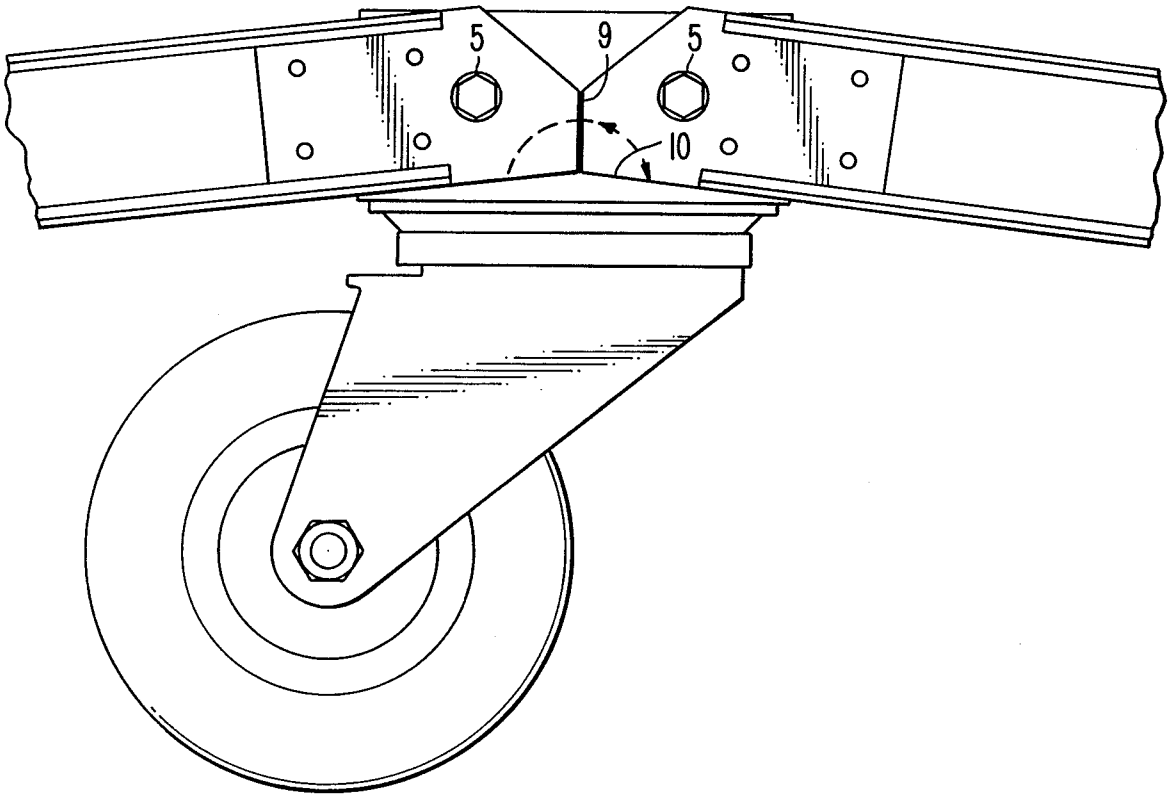
FIG. 4 shows two adjoining section ends, fully folded out.

FIG. 4 shows how the section end pieces 5 engage against one another when the ladder is fully folded out. Attention is drawn to the fact that the angle between the engaging surface 9 and the direction of the side rail 10 is greater than 90°.

Figure 5:
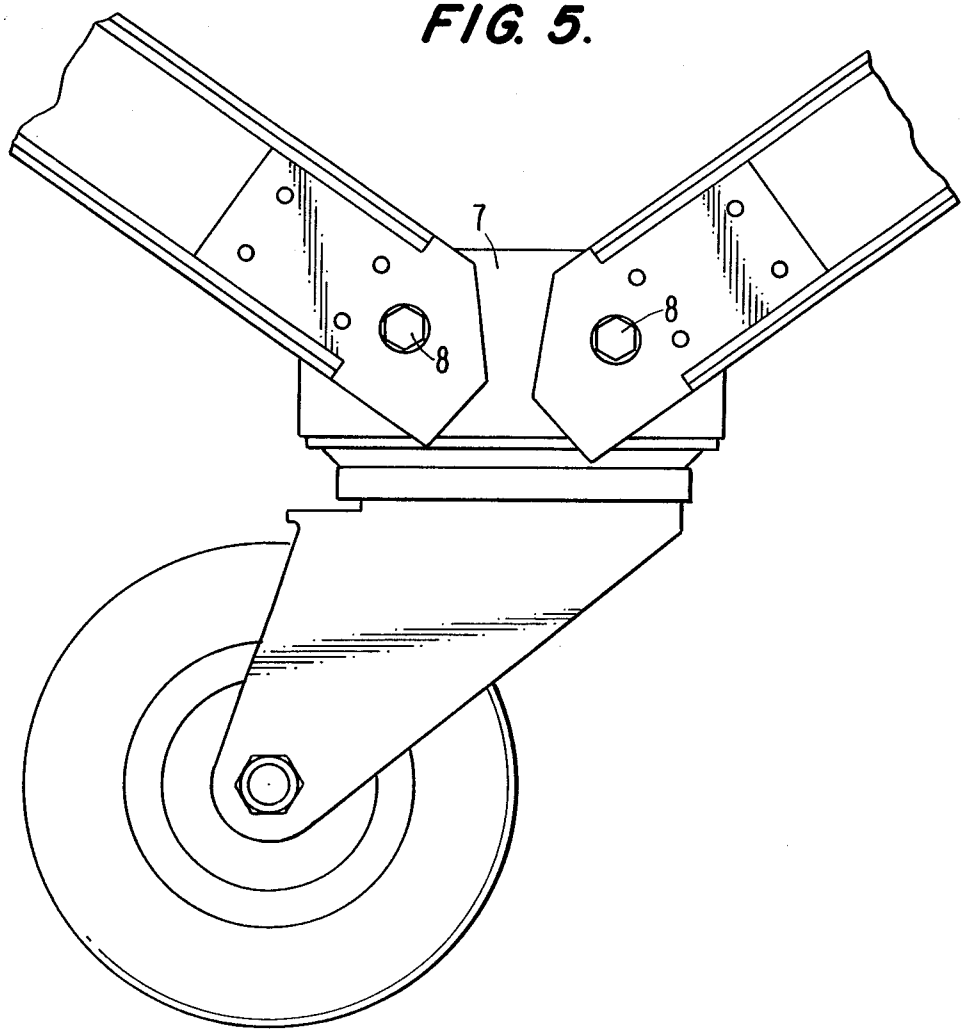
FIG. 5 shows two adjoining section ends, as in FIG. 4, with the ladder partly folded out.

FIG. 5 illustrates more clearly L-shaped bracket 7 with the articulated joints provided by screws 8.

Figure 6A:
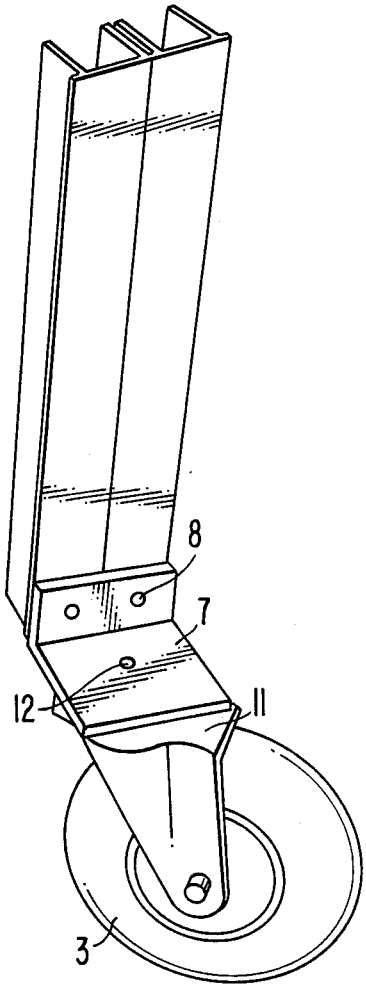
FIG. 6A shows the bracket relative to the side rails of two sections of the ladder with the ladder completely folded together.
Figure 6B:
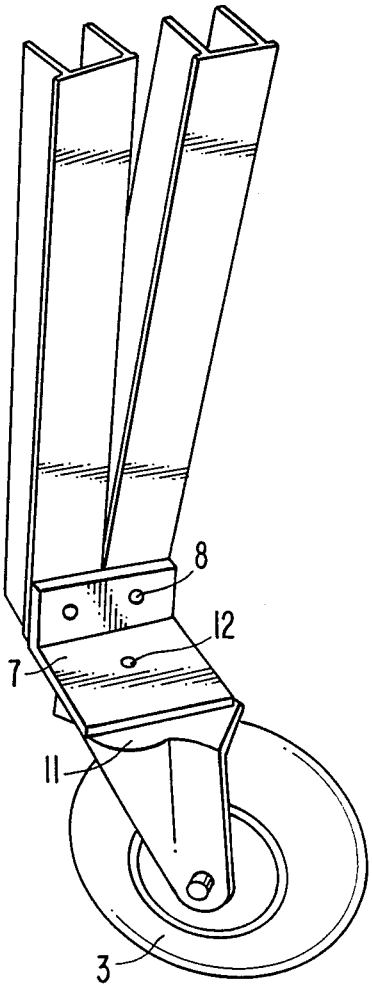
FIG. 6B is similar to FIG. 6A with the ladder partly unfolded.

FIG. 6 shows, in perspective, the articulated joints provided by screws 8 through brackets 7. 12 is the centre fixture for the castors 3 on their suspensions 11.

Figure 7A:
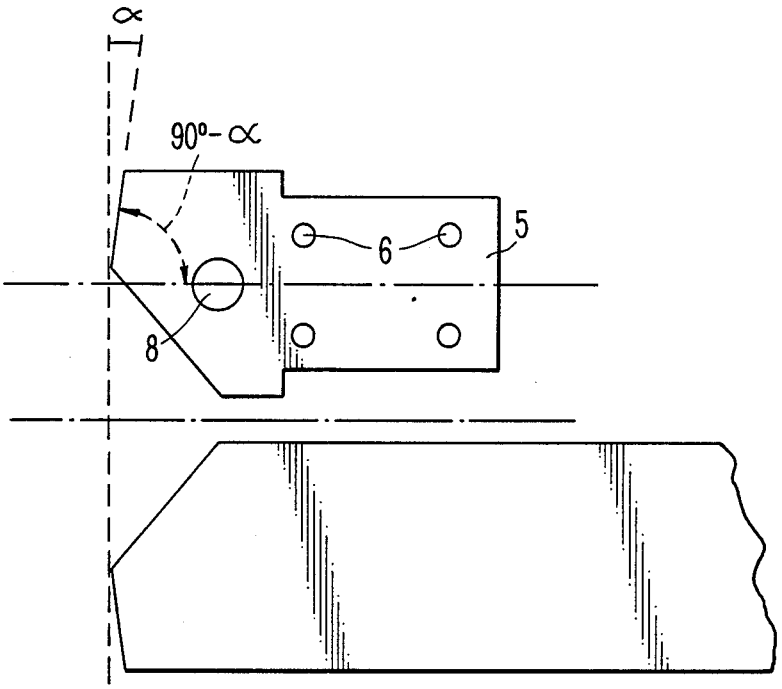
FIG. 7A illustrates a section end piece on its own, as seen from the front.
Figure 7B:
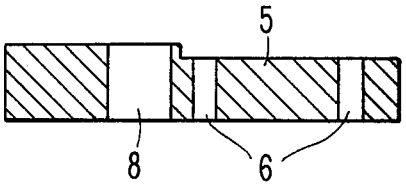
FIG. 7B.

FIG. 7 illustrates a section end piece 5 on its own, with holes 6 for fixing screws and a larger hole 8 for the bolt which connects the end pieces through bracket 7.

The operation of the sectioned, articulated radome ladder for use on the external surface of a spherical structure is as follows.

The radome ladder is transported in the folded state up to the workplace. On the top of the radome there is a block. A line through this block is fixed to the top of the radome ladder which is furnished with a suitable shackle. When the line is pulled up, for example, by means of a car, the ladder will become unfolded and be drawn up into position.

It goes without saying that the side rails of the radome ladder have already been fitted with section end pieces suitable for the building in question. As soon as the ladder has been drawn up into position, the operator can climb up to his workplace with the necessary tools. At work, the operator lies against a rigid structure, as opposed to an operator on a rope ladder. The radome ladder is moved sideways by an assistant whilst the operator lies against the ladder. It is preferable to have pneumatic tires on the castors to avoid damaging the surface of the radome.

Similarly, the castors should have ball bearings.

By way of example for an embodiment, it may be mentioned that a 30 foot dome would require an angle alpha of 7°. For a 50 foot dome, the angle would be 3°. A section length of 2.15 meters have been chosen. On really large domes, for example, 60 ft. or more, the angle could be zero, provided the castors were large enough to prevent the ladder from touching the dome.

I claim:

1. A sectioned, articulated ladder for use on the external surface of a spherical structure, said ladder comprising:

a plurality of rigid ladder sections, each one of said plurality of rigid ladder sections including a pair of spaced opposed elongated side members, and a plurality of rungs spaced apart along the length of said pair of side members, attached to each one of said pair of side members, and extending to the other one of said pair of side members;

hinge means attached to said plurality of rigid ladder sections for interconnecting adjacent ones of said plurality of ladder sections end to end, and for causing adjacent ones of said ladder sections to rotate relative to each other when said ladder is folded into an unextended position and unfolded into an extended position;

angle limiting means attached to said plurality of rigid ladder sections for limiting the angle of rotation between adjacent ones of said plurality of rigid sections when said ladder is folded and unfolded, said angle limiting means having a first means for causing adjacent ones of said rigid ladder sections to lie parallel to each other in accordion-like fashion when said ladder is folded, and said angle limiting means having a second means for causing adjacent ones of said rigid sections to lie at a fixed angle of less than 180° relative to each other when said ladder is in its unfolded extended position; and a plurality of castors rotatably attached to said plurality of rigid ladder sections for movably supporting said plurality of rigid ladder sections when said ladder is in its unfolded extended position and on the external surface of a spherical structure.

2. A ladder as in claim 1, wherein said hinge means includes a plurality of hinges, at least one hinge of said plurality of hinges is attached to adjacent ones of said plurality of rigid ladder sections, said first means for causing adjacent ones of said rigid ladder sections to lie parallel to each other includes a first surface on each said hinge having a first shape for causing adjacent ones of said hinges to lie parallel to each other, and said second means for causing adjacent ones of said rigid ladder sections to lie at a fixed angle of less than 180° relative to each other includes a second surface on each said hinge having a second shape for abutting the second shape of the second surface of an adjacent hinge for causing adjacent ones of said plurality of rigid ladder sections to lie at a fixed angle of less than 180° relative to each other when said ladder is unfolded and the second surfaces of adjacent hinges abut.

3. A ladder as in claim 2, wherein an end piece is attached to an end of each one of said plurality of rigid ladder sections, said first and second surfaces are defined on each said end piece, each one of said plurality of hinges is a substantially L-shaped bracket pivotably attached to adjacent ones of said end pieces, and one of said plurality of castors is rotatably attached to each one of said substantially L-shaped brackets.

* * * * *